United States Patent [19]

Seiler

[11] 4,060,101

[45] Nov. 29, 1977

[54] DOUBLE LIFT, OPEN SHED JACQUARD LOOM

[75] Inventor: Wolfgang Seiler, Munchen-Gladbach, Germany

[73] Assignee: Firma Oskar Schleicher, Munchen-Gladbach, Germany

[21] Appl. No.: 703,701

[22] Filed: July 8, 1976

[30] Foreign Application Priority Data

July 10, 1975 Germany ..... 2530799

[51] Int. Cl.[2] ..... D03C 3/08

[52] U.S. Cl. ..... 139/65; 139/59

[58] Field of Search ..... 139/59–65, 139/85

[56] References Cited

U.S. PATENT DOCUMENTS

| | | | |
|---|---|---|---|
| 443,235 | 12/1890 | Garlick et al. | 139/63 |
| 625,563 | 5/1899 | Kelmel | 139/63 |
| 687,223 | 11/1901 | Garlick et al. | 139/63 |
| 2,148,088 | 2/1939 | Short | 139/59 |
| 2,868,232 | 1/1959 | Foster et al. | 139/59 |
| 3,455,339 | 7/1969 | Seiler | 139/65 X |
| 3,967,652 | 7/1976 | Seiler | 139/65 X |

*Primary Examiner*—James Kee Chi

*Attorney, Agent, or Firm*—Lowe, King, Price & Markva

[57] ABSTRACT

A double lift, open shed Jacquard loom comprises a Jacquard prism and a plurality of hooks controlled by suitable control needles. The leg of each hook contains three hook noses that are engageable with upper and lower sets of opposed, parallel knives. The sets of knives are movable toward and away from each other by a crank or camming mechanism. The hook noses are also engageable with a stationary set of arresting knives. The hook are guided and maintained separated from each other by upper and lower stationary rakes, and the upper set of knives is located above the upper rake. In order to reduce friction between the hooks and rakes caused by sliding contact therebetween, lifting of the hooks by the upper set of knives is vertically guided along a curved path, and lifting by the lower set of knives is vertically guided along a straight line path. As a result, the hooks are urged sideways only above the upper rake; friction is reduced because the hooks are not pressed sideways against the rakes during lifting.

11 Claims, 5 Drawing Figures

FIG. 2
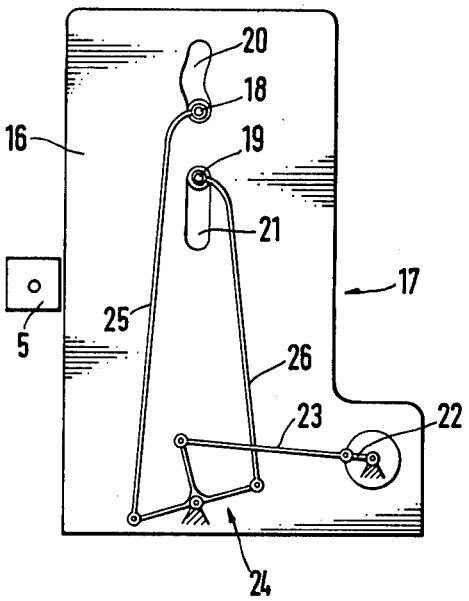
FIG. 3
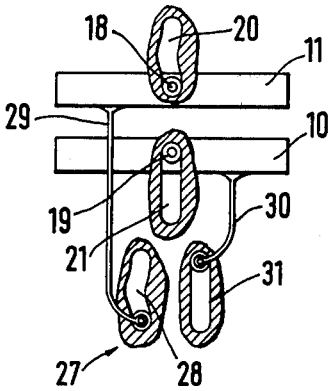
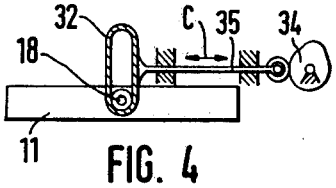
FIG. 4
FIG. 1
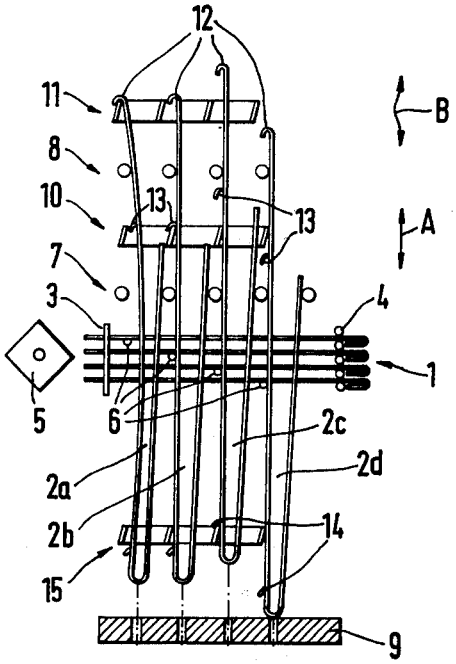
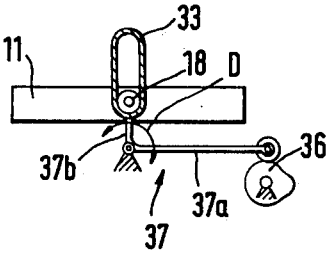
FIG. 5

DOUBLE LIFT, OPEN SHED JACQUARD LOOM

BACKGROUND OF THE INVENTION

The present invention relates generally to a Jacquard loom, and more particularly, toward a Jacquard loom having hooks extending vertically between upper and lower rakes, the hooks being lifted by parallel sets of knives along a non-linear path so as to reduce friction between the hooks and rakes.

In German Pat. No. 2,344,363, there is described a double lift, open shed Jacquard loom having a lower set of lifting knives that laterally shifts during both upward and downward movement, and an upper set of knives that moves vertically along a straight line. Alternatively, the upper and lower sets of knives are alternately laterally shiftable during upward and downward movement. These measures prevent the descending hooks with unsupported hook noses from unintentionally coming into engagement with an assigned knife of a rising set of knives.

In the area between the upper and lower hook rakes, transverse forces are exerted on the hooks which lead to flexing of the hooks in that area. As a consequence strong tension and frictional forces arise, and the standard downward pull of the hooks by weights or springs does not sufficiently hold the hooks on the lower set of lifting knives. Furthermore, as a result of friction, the energy required for moving the hooks is substantial, and a great amount of wear can be caused within a short time.

SUMMARY OF THE INVENTION

In accordance with the present invention, a Jacquard loom comprises a Jacquard prism and a plurality of hooks lifted by parallel sets of knives in accordance with a set of control needles. The needles in turn are controlled by the Jacquard prism, in a well known manner. The hooks are formed from wire and each contains sinker noses disposed along a straight leg portion. The lower end of the leg, after a flexure of about 180°, continues along a resilient extension of the hook leg. The upper set of knives is transversely guided in both the upward and downward directions of lift between the upper and lower dead centers of movement of the hooks, whereby a component of movement of the upper set of knives toward the Jacquard prism is developed. Lift for the lower set of knives, however, is developed along a straight line. As a result, the hook, moved up and down by the upper set of knives, are deviated laterally by being pressed sideways only above the upper hook rake. The hooks moved by the lower set of lifting knives, however, do not move laterally, and therefore move freely without friction.

The vertical stroke and transverse movement of the upper set of knives are synchronized to each other such that the movement of those knives takes place along a sinusoidal line. The deflecting path of the upper set of knives, transverse to the direction of the lift, lies effectively in the range from 8 to 15 mm.

In accordance with one embodiment of the invention, the upper set of knives is attached to lateral guide pegs slidably engaged in a curved guide. The guide is fixed in relation to the loom frame. In order to prevent angular deflection of the upper lifting knives, a parallel guiding arrangement is provided, including an arm rigidly attached to each knife and spaced apart from the lateral guide peg on each knife. A free end of the arm is guided along a fixed sliding path corresponding to the curved guide.

In another embodiment, the upper set of knives is mounted with lateral pegs in a straight guide that is movable in one lifting direction. The straight guide itself is shiftable transversely to the lifting direction. In order to produce transverse movement of the guide, a slide is provided that is controlled by a swivelling lever controlled by a cam, or else by a cam directly.

OBJECTS OF THE INVENTION

Accordingly, one object of the present invention is to provide a new and improved Jacquard loom.

Another object of the present invention is to provide a new and improved double lift, open shed Jacquard loom, wherein frictional forces by sliding contact of hooks during flexure thereof against hook rakes is minimized.

Still another object of the present invention is to provide a new and improved double lift, open shed Jacquard loom comprising a plurality of vertically movable hooks guided and separated from each other by upper and lower rakes, wherein friction between the hooks and rakes is reduced.

Yet another object of the present invention is to provide a double lift, open shed Jacquard loom having a plurality of vertically movable hooks extending between sets of stationary rakes, and hook noses formed on the hooks for engagement with parallel knives for lifting the hooks, wherein the knives are moved along paths tending to minimize friction between the hooks and the rakes.

Still other objects and advantages of the present invention will become apparent to those skilled in this art from the following detailed description, wherein I have shown and described only the preferred embodiments of the invention, simply by way of illustration of the best modes contemplated by me of carrying out my invention. As will be realized, the invention is capable of other and different embodiments, and its several details are capable of modifications in various obvious respects, all without departing from the invention. Accordingly, the drawings and description are to be regarded as illustrative in nature, and not as restrictive.

BRIEF DESCRIPTION OF THE DRAWINGS

FIG. 1 is a schematic illustration of a Jacquard loom, only four control needles and four hooks being shown for clarity;

FIG. 2 is a side view of the loom of FIG. 1, showing a preferred embodiment of the driving elements for the opposed sets of knives;

FIG. 3 is a schematic illustration of the parallel guide arrangement for the opposed sets of knives; and FIGS. 4 and 5 are illustrations of additional embodiments for the production of a transverse movement of the upper set of knives during the rising and descending movement of the lift (stroke).

DETAILED DESCRIPTION OF THE PREFERRED EMBODIMENTS

Referring to FIG. 1, control needles 1 mounted on needle board 3 and in needle rake 4 are controlled in a known manner by a schematically shown Jacquard prism 5. Pulses from prism 5 are transferred to hooks *2a–2d* by angular projections 6 disposed on control needles 1. The hooks *2a–2d* are guided between a lower hook rake 7 and an upper hook rake 8, and are supported in their rest position on a fixed bottom board 9. Above the lower hook rake 7, there is a lower set of knives 10 mounted on lifting bars (not shown) and above the hook rake 8, there is an upper set of knives 11. The hooks 2a–2d are wire-like, and bent around an angle of about 180° at a lower portion thereof (see FIG. 1).

The sets of knives 10 and 11, in a known manner, carry some of the shed hooks 2a–2d, which have not been forced away by control needles 1, toward upper shed positions and correspondingly carry certain other shed hooks 2a–2d in lower shed positions. For this purpose, the hooks 2a–2d contain hook noses 12 and 13. In the upper shed position (see hook 2c), the hooks 2a–2d are supported with hook nose 14 on a set of arresting knives 15, disposed below control needles 1. The two sets of knives 10 and 11 are oriented without crossing (parallel), are opposed and are movable toward and away from each other. The lower set of knives 10 is moved up and down in a straight line corresponding to the direction of arrow A. The upper set of knives 11, housed in a conventional lifting bar (not shown), carries out a lifting movement indicated by arrow B. The movement corresponding to arrow B differs from the movement characterized by arrow A by an additional transverse movement directed toward Jacquard prism 5. The additional movement approximately follows a sinusoidal line which has its maximum at the point of crossing of hooks 2a–2d, that is, where the upper hooks change places with the lower hooks. The magnitude of the transverse movement is preferably in the range of 8 to 15 mm.

In FIG. 1, the hook 2a as shown, happens to move downwardly as the hook 2b moves upwardly, demonstrating the position of crossing, mentioned above. In this position, the upper set of knives 11 has reached its farthest deviation toward Jacquard prism 5. As can be seen, the upper end of hook 2a is bent to the left so that the lower hook nose 13 will get past the assigned lower knife of the lower set of knives 10. Simultaneously, hook 2b with its upper hook nose 12, can move freely past the assigned knife of the upper set of knives 11. The unoperated hook 2c is supported with its hook nose 14 on the set of arresting knives 15, while the unoperated hook 2d is supported on sinker bottom 9.

FIG. 2 schematically shos sidewall 16 of machine frame 17 of a Jacquard loom. In the embodiment shown, the sets of knives 10 and 11 have lateral guide pegs 18 and 19. Guide pegs 18 are guided in a curved guide 20 disposed on machine frame 17. The shape of guide 20 corresponds to the desired movement of the upper set of knives 11. Guide pegs 19 of the lower set of knives 10 are guided in a straight-line shaped guide 21. The opposed drive to knives 10 and 11 is accomplished by schematically shown crank 22 through a sliding drive 23 coupled to a rocking lever 24 as well as to connecting rods 25 and 26 that are articulated to pegs 18 and 19.

FIG. 3 shows a parallel guide arrangement 27 for the sets of knives 10 and 11. In addition to the guide 20, the slideway 28, corresponding in shape to guide 20, is disposed in fixed relation to housing or frame 17. The free end of an arm 29, rigidly attached to the upper set of knives 11 and spaced apart from the lateral guide pegs 18 on the set of knives 11, is guided in the slideway 31. Correspondingly, an arm 30, attached to the set of knives 10, is guided in a straight line slideway 31.

FIGS. 4 and 5 show additional embodiments of transverse guide arrangements for the upper set of knives 11. The lateral guide pegs 18 are mounted to be shiftable along a vertical straight line in a straight guide 32 or 33 for lifting. Straight guide 32 or 33 is movable transversely to the direction of lift. In the embodiment of FIG. 4, transverse movement is provided by a slide 35 controlled by a cam 34 in correspondence with the directional arrow C. In the embodiment of FIg. 5, transverse movement is provided by an arrangement 37 of a swivelling lever controlled by a cam 36 acting on lever arms 37a and 37b in the direction of arrow D. In each embodiment, vertical movement is imparted to the knives 11 with a conventional lifting bar (not shown).

In this disclosure, there is shown and described only the preferred embodiments of the invention, but, as aforementioned, it is to be understood that the invention is capable of use in various other combinations and environments and is capable of changes or modifications within the scope of the inventive concept as expressed herein.

What is claimed is:

1. A double lift, open shed Jacquard comprising:
a plurality of hooks controlled by control needles;
first and second mutually parallel, opposed, vertically spaced apart sets of knives;
a Jacquard prism for controlling said needles;
lifting means for lifting said first and second sets of knives toward and away from one another without crossing;
transverse guide means for producing a transverse component of movement toward said Jacquard prism in both up and down directions of lift of said upper set of knives, said transverse component of movement occurring between upper and lower centers of movement of said upper set of knives; and
straight line guide means for guiding the lower set of knives along a straight line path.

2. The double lift, open shed Jacquard as in claim 1, wherein said lifting means and transverse guide means move the upper set of knives along a sinusoidal path.

3. The double lift, open shed Jacquard as in claim 1, wherein a path of deviation of the upper set of knives transverse to the up and down directions of lift is in the range from 8 to 15 mm.

4. The double lift, open shed Jacquard as in claim 1, wherein the upper set of knives includes lateral guide pegs, said pegs slidably engaged within a curved guide having a shape corresponding to a desired movement of said upper set of knives, said curved guide means being stationary relative to a frame member of said Jacquard.

5. The double lift, open shed Jacquard as in claim 4, including parallel guide means for guiding the upper set of knives.

6. The double lift, open shed Jacquard as in claim 5, wherein the parallel guide means includes rigid arm means attached to said upper set of knives and spaced apart from said lateral guide pegs on the upper set of knives, a free end of said arm means being guided in a locally fixed slideway corresponding in shape to the curved guide.

7. The double lift, open shed Jacquard as in claim 1, wherein the upper set of knives is attached to lateral guide pegs, and further including lifting means shiftably engaging said pegs, said lifting means including a straight guide movable transversely relative to the upward and downward directions of lift.

8. The double lift, open shed Jacquard as in claim 7 including a slide for producing the transverse movement of said straight guide, said slide being controlled by a cam.

9. The double lift, open shed Jacquard as in claim 7 including rocking lever means for producing the transverse movement of said straight guides, said rocking lever means being controlled by a cam.

10. The double lift, open shed Jacquard as in claim 1 wherein said hooks include a plurality of hook noses engageable to the upper and lower sets of knives.

11. The double lift, open shed Jacquard as in claim 10, further including a stationary set of arresting knives located below said hooks, and an upper and lower stationary hook rake for guiding and separating said hooks from each other.

* * * * *